US010294740B2

(12) United States Patent
Holtby et al.

(10) Patent No.: US 10,294,740 B2
(45) Date of Patent: May 21, 2019

(54) WELL FLUID CONTAINMENT DEVICE WITH SAFETY MECHANISM

(71) Applicant: Katch Kan Holdings Ltd., Edmonton (CA)

(72) Inventors: Quinn A. J. Holtby, Edmonton (CA); Dallas Laird Greenwood, Edmonton (CA)

(73) Assignee: Katch Kan Holdings Ltd., Edmonton (CA)

( * ) Notice: Subject to any disclaimer, the term of this patent is extended or adjusted under 35 U.S.C. 154(b) by 145 days.

(21) Appl. No.: 14/973,576

(22) Filed: Dec. 17, 2015

(65) Prior Publication Data

US 2016/0177641 A1 Jun. 23, 2016

Related U.S. Application Data

(60) Provisional application No. 62/093,941, filed on Dec. 18, 2014.

(51) Int. Cl.
*E21B 21/01* (2006.01)
*E21B 19/16* (2006.01)

(52) U.S. Cl.
CPC ..... *E21B 21/01* (2013.01); *E21B 19/16* (2013.01)

(58) Field of Classification Search
CPC ..... E21B 21/01
See application file for complete search history.

(56) References Cited

U.S. PATENT DOCUMENTS

| | | | | |
|---|---|---|---|---|
| 234,825 | A | 11/1880 | Walker | |
| 560,986 | A | 5/1896 | Grow | |
| 1,369,913 | A * | 3/1921 | Brunhoff | E21B 33/08 166/81.1 |
| 1,418,612 | A | 6/1922 | Beard | |
| 1,498,075 | A * | 6/1924 | Dale | E21B 33/0422 277/322 |
| 1,632,889 | A * | 6/1927 | Davis | E21B 33/08 15/220.4 |

(Continued)

FOREIGN PATENT DOCUMENTS

CA 2163322 A1 5/1997

OTHER PUBLICATIONS

"Kelly Kan™: Controls and Redirects Fluid Discharge," brochure, www.katckan.com, 2007, pp. 6-7.

(Continued)

*Primary Examiner* — Matthew R Buck
*Assistant Examiner* — Aaron L Lembo
(74) *Attorney, Agent, or Firm* — Christensen O'Connor Johnson Kindness, PLLC

(57) ABSTRACT

Well fluid containment devices and methods. A housing may be provided for positioning around a pipe. A pipe gripping surface or grappler may be mounted to the housing. The pipe gripping surface resists movement when contacted in a first axial direction. The pipe gripping surface may permit movement when contacted in a second axial direction opposed to the first direction. The pipe gripping surface may, when contacted with a first force in a first axial direction, resist movement with an opposing force that increases as the first force increases. There may be a pressure relief connector between housing sections.

20 Claims, 5 Drawing Sheets

(56) References Cited

U.S. PATENT DOCUMENTS 1,704,493 A * 3/1929 Wilhelm ..... E21B 21/01 173/78
1,801,995 A * 4/1931 Bell ..... E21B 33/08 15/220.4
1,809,175 A 6/1931 Loomis
1,448,243 A 9/1931 Wilson
1,868,794 A * 7/1932 Fuller ..... E21B 33/08 118/125
1,910,045 A * 5/1933 Paryzek ..... E21B 33/08 166/81.1
2,096,882 A * 10/1937 Chernosky ..... E21B 33/08 15/220.4
2,137,832 A 11/1938 Cordes
2,353,412 A 7/1944 Miller
2,382,455 A * 8/1945 Turechek ..... E21B 33/1293 166/134
2,510,114 A * 6/1950 Hummel ..... E21B 33/08 15/220.4
2,611,146 A * 9/1952 Buckley ..... E21B 33/08 15/104.04
2,762,638 A * 9/1956 Brown ..... E21B 33/06 277/343
2,936,031 A * 5/1960 Seago ..... E21B 37/02 166/173
3,270,810 A 9/1966 Johnston
3,322,198 A * 5/1967 McHenry ..... E21B 21/01 166/81.1
3,412,804 A * 11/1968 Turbyfill ..... E21B 37/02 166/173
3,422,483 A * 1/1969 Craycraft ..... E21B 33/08 15/220.4
4,450,905 A 5/1984 Crain
4,690,213 A * 9/1987 Stannard ..... E21B 33/08 166/82.1
5,217,069 A * 6/1993 Badon ..... E21B 33/08 15/220.4
5,295,536 A 3/1994 Bode
5,323,854 A * 6/1994 Pursley, Jr. ..... E21B 33/0422 166/75.13
5,484,024 A * 1/1996 Ladd ..... E21B 33/08 166/369
5,551,511 A 9/1996 Holtby
6,119,772 A * 9/2000 Pruet ..... E21B 21/01 166/81.1
8,555,980 B1 * 10/2013 Powell ..... E21B 43/0122 166/363
9,022,103 B2 * 5/2015 Roehm ..... E21B 43/0122 137/315.02
9,057,243 B2 * 6/2015 Hendel ..... E21B 33/064
D744,063 S * 11/2015 Holtby ..... D23/200
9,388,657 B2 * 7/2016 Nelson ..... E21B 33/06
9,453,392 B1 * 9/2016 Marchiori ..... E21B 33/08
2011/0108278 A1 * 5/2011 Holtby ..... E21B 17/006 166/311
2014/0124222 A1 * 5/2014 Holtby ..... E21B 17/006 166/387
2014/0203547 A1 7/2014 Krueger et al.
2014/0238530 A1 * 8/2014 Holtby ..... E21B 21/01 141/1
2014/0360593 A1 12/2014 Holtby et al.
2017/0002626 A1 * 1/2017 Hendel ..... E21B 33/064

OTHER PUBLICATIONS

"Well Servicing ZSS™ Solution," Katch Kan, Edmonton, Canada, 1-page brochure, at least as early as Feb. 1, 2013.

* cited by examiner

WELL FLUID CONTAINMENT DEVICE WITH SAFETY MECHANISM

TECHNICAL FIELD

This document relates to well fluid containment devices with safety mechanisms.

BACKGROUND

Mud cans are installed around a pipe joint to control and re-direct drilling fluid discharge from joint break out. One such product is the KELLY KAN™ made by Katch Kan Ltd. of Edmonton, Canada. A mud can is also described in PCT publication number WO2011020196.

SUMMARY

Well fluid containment devices and methods are disclosed. A housing may be provided for positioning around a pipe or other tubular. A pipe gripping surface may be mounted to the housing.

A well fluid containment device is disclosed comprising: a housing formed of sections connected together, the housing having an interior wall defining a pipe joint passage; and a safety mechanism supported by the housing and having a pipe gripping surface that resists movement when contacted in a first axial direction and permits movement when contacted in a second axial direction opposed to the first direction.

A method of containing well fluids is also disclosed, the method comprising: mounting a housing around a portion of pipe, the portion containing a pipe joint, in which a safety mechanism on the housing grips the portion of pipe above the pipe joint; disconnecting the pipe joint to release well fluids; in which the safety mechanism joint resists movement when contacted in an upward axial direction by the released pressurized well fluids. The safety mechanism may also permit downward movement when contacted in a downward axial direction.

A well fluid containment device is disclosed comprising: a housing formed of sections connected together, the housing having an interior wall defining a pipe joint passage; and a safety mechanism supported by the housing and having a pipe gripping surface, which, when contacted with a first force in a first axial direction, resists movement with an opposing force that increases as the first force increases.

A well fluid containment device is disclosed comprising: a housing formed of sections connected together, the housing having an interior wall defining a pipe joint passage; and a pressure relief connector between the sections.

In various embodiments, there may be included any one or more of the following features: The pipe gripping surface deflects outward when contacted in the second axial direction. The safety mechanism comprises a collar disposed about the pipe joint passage and defining the pipe gripping surface. The safety mechanism comprises a shoulder that extends from the housing and defines the pipe gripping surface. The second axial direction is toward a first end of the housing, and the shoulder extends radially inwards and toward the first end, and terminates in the pipe gripping surface. The shoulder is separated into plural members, each plural member defining a respective pipe gripping surface. The plural members each have an arcuate shape. The plural members overlap one another. The second axial direction is toward a first end of the housing, and the plural members extend radially inwards and toward the first end, and terminate in respective pipe gripping surfaces. The plural members comprise plural arms circumferentially arranged about the interior wall. Each of the plural arms is angled toward the first end from an arm base to a respective pipe gripping surface. Each of the plural members is secured by a respective fastener. The shoulder has the general shape of an upside down funnel. The shoulder consists of rigid material. A pipe seal lining the interior wall at or near a top end of the housing. The safety mechanism is closer to the top end than the pipe seal. A portion of pipe is positioned in the pipe joint passage, the portion of pipe being gripped by the pipe gripping surface, the portion of pipe comprising a pipe joint. Each connector may be formed of parts, for example the parts that make up a latch, with a connector part positioned on one section and a connector part positioned on the other section. The sections are arcuate sections. The sections are connected by hinge. The housing comprises sections connected together, and mounting comprises closing and securing the sections together around the portion of pipe. The pipe is a kelly. When contacted with a first force in a first axial direction, the safety mechanism resists movement with an opposing force that increases as the first force increases. The gripping surface may include angled rigid elements to prevent upward movement of the device relative to the pipe. The housing has a top end and a base end, and the pressure relief connector is closer to the base end than the top end. The pressure relief connector is a first connector, the housing has a top end and a base end, and further comprising a second connector on the sections, the first connector being closer to the base end than the second connector. The connector comprises a latch.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
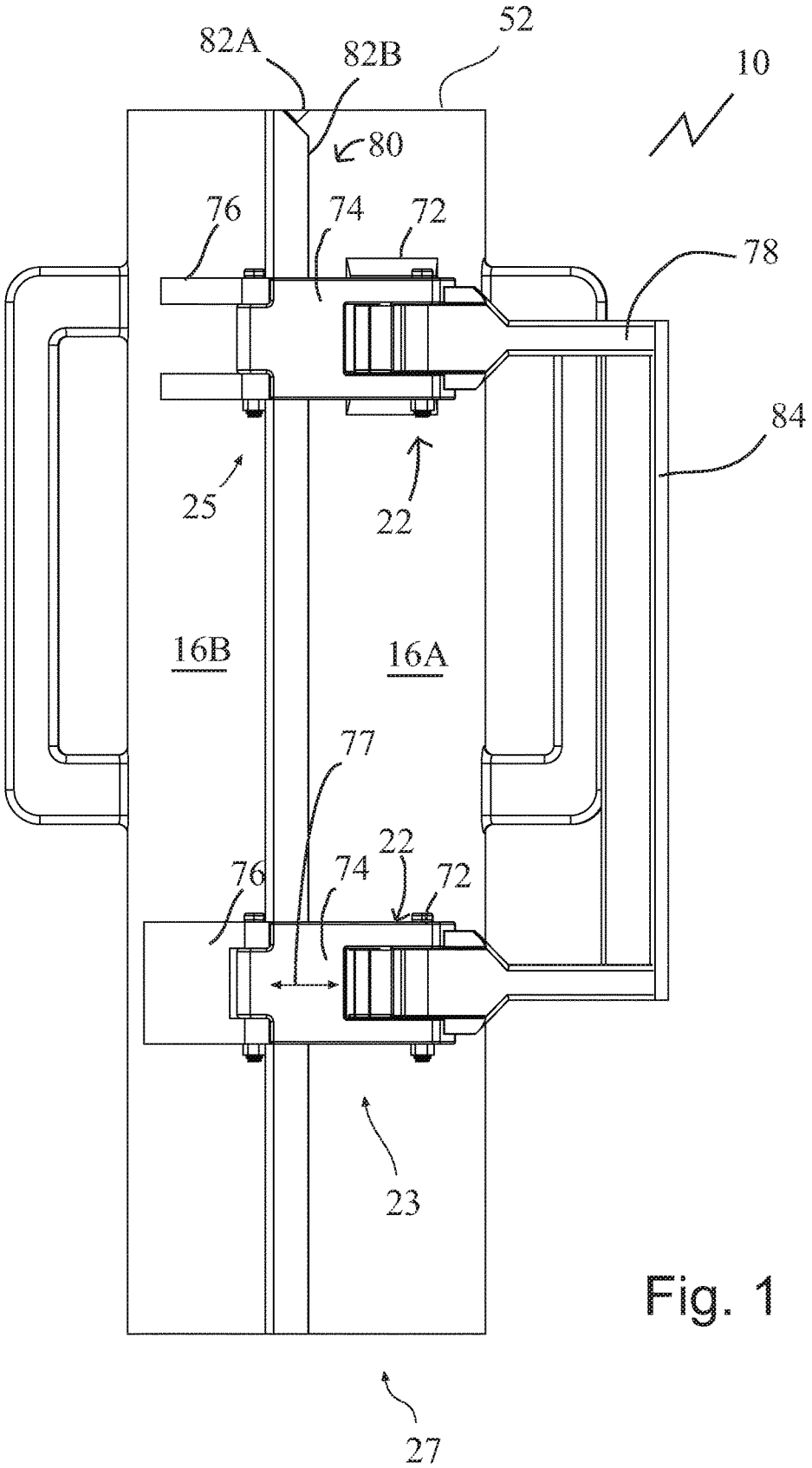
FIG. 1 is a side elevation view of a well fluid containment device.

Immaterial modifications may be made to the embodiments described here without departing from what is covered by the claims.

During the drilling of a well, drilling fluid is pumped down a hollow drill string and into or out of a drill bit at the end of the drill string. The drill string comprises a plurality of joined sections of pipe. The drilling fluid is pumped down the drill string using a device known as a kelly. The kelly is attached to the top of the drill string. The kelly is configured to allow the drill string to rotate when drilling the well while the hose remains generally stationary.

The kelly is often a section of pipe with a polygonal (three-, four-, six-, or eight-sided for example), splined or other non-circular outer profile. The kelly passes through a matching kelly (mating) bushing and rotary table in a kelly drive system. The bushing is rotated via the rotary table and thus the pipe and the attached drill string turn while the kelly is free to slide vertically in the bushing as the bit digs the well deeper. When drilling, the drill bit is attached at the end of the drill string and thus the kelly drive provides the means to turn the bit, assuming that a downhole motor is not being used.

Together the kelly and kelly bushing are referred to as a kelly drive. The upper end of the kelly may be screwed into the swivel, using for example a left-hand thread to preclude loosening from the right-hand torque applied below. The kelly may be longer than the drill pipe segments, thus leaving a portion of newly drilled hole open below the bit after a new length of pipe has been added and the drill string has been lowered until the kelly bushing engages again in the rotary table.

The kelly is a connected to a source of pressurized drilling fluid via a hose, known as a kelly hose. Thus, pressurized drilling fluid is pumped through the kelly and into the drill string during drilling operations. The drilling fluid serves to carry cuttings produced by the drill bit to the surface in the space between the drill string and the walls of the well hole being drilled. This space is often referred to as the annulus. The drilling fluid also creates a hydrostatic pressure in the annulus that restricts produced substances from blowing out of the well.

The kelly hose may be a flexible, high-pressure hose connected from a standpipe to a gooseneck pipe on a swivel above the kelly. The kelly hose allows the free vertical movement of the kelly while facilitating the flow of the drilling fluid down the drill string.

The process of removing the drill string from the well may comprise raising the drill string out of the well and disconnecting one or more sections of joined pipe from the drill string. This and other drill string removal processes are often referred to as tripping out. Before the pipe sections are removed, the kelly is removed from the drill string. A kelly and its associated hose may contain twenty or more gallons of drilling fluid under pressure. Each section of pipe being tripped out may also contain drilling fluid inside. When the kelly or a pipe section is disconnected from the drill string, the drilling fluid in the kelly or the pipe section may spill out uncontrollably over the drilling rig floor and the personnel drilling the well. Such fluid release thus creates a potentially unsafe and hazardous environment for personnel to work in.

Figure 2:
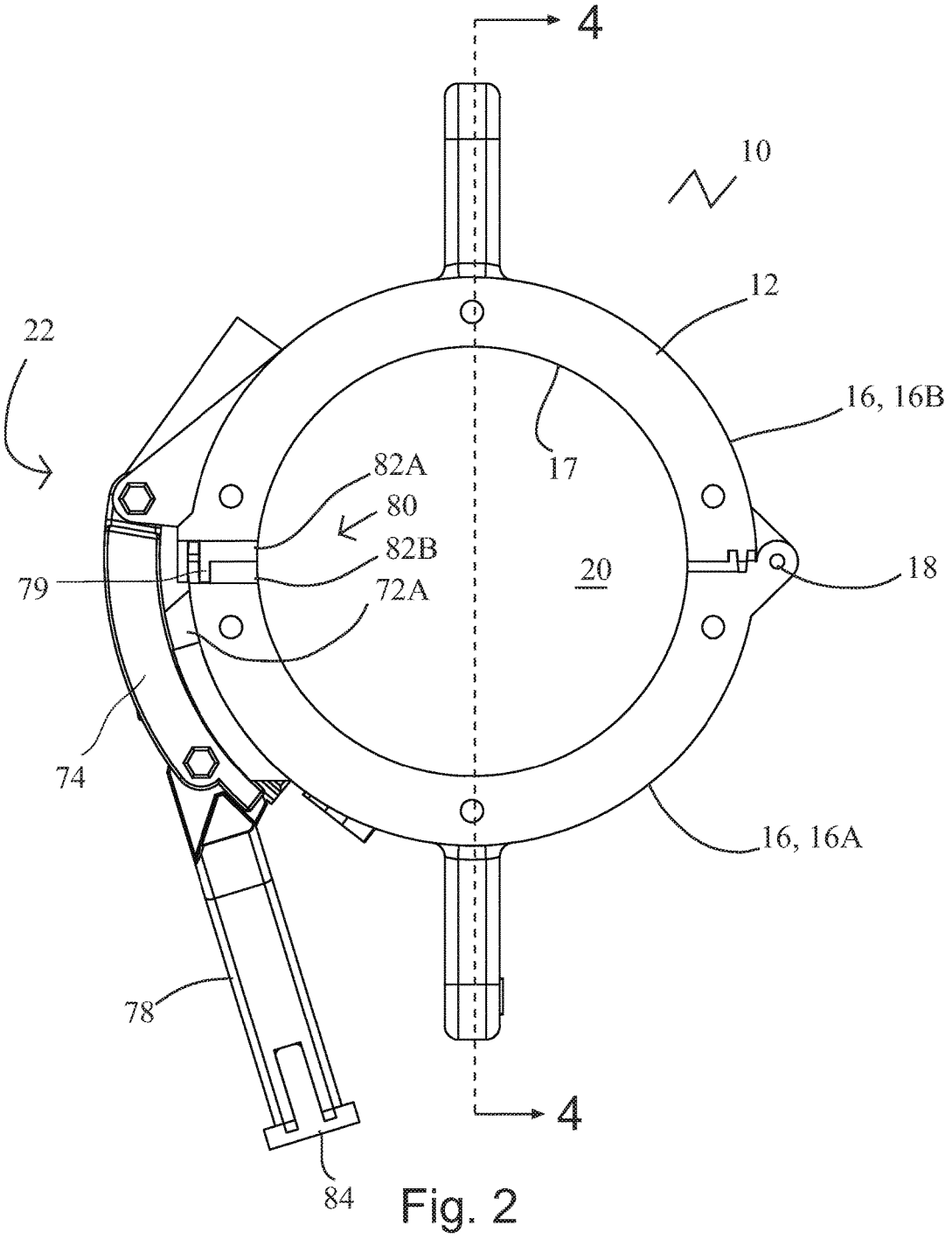
FIG. 2 is a top plan view of the device of FIG. 1.
Figure 3:
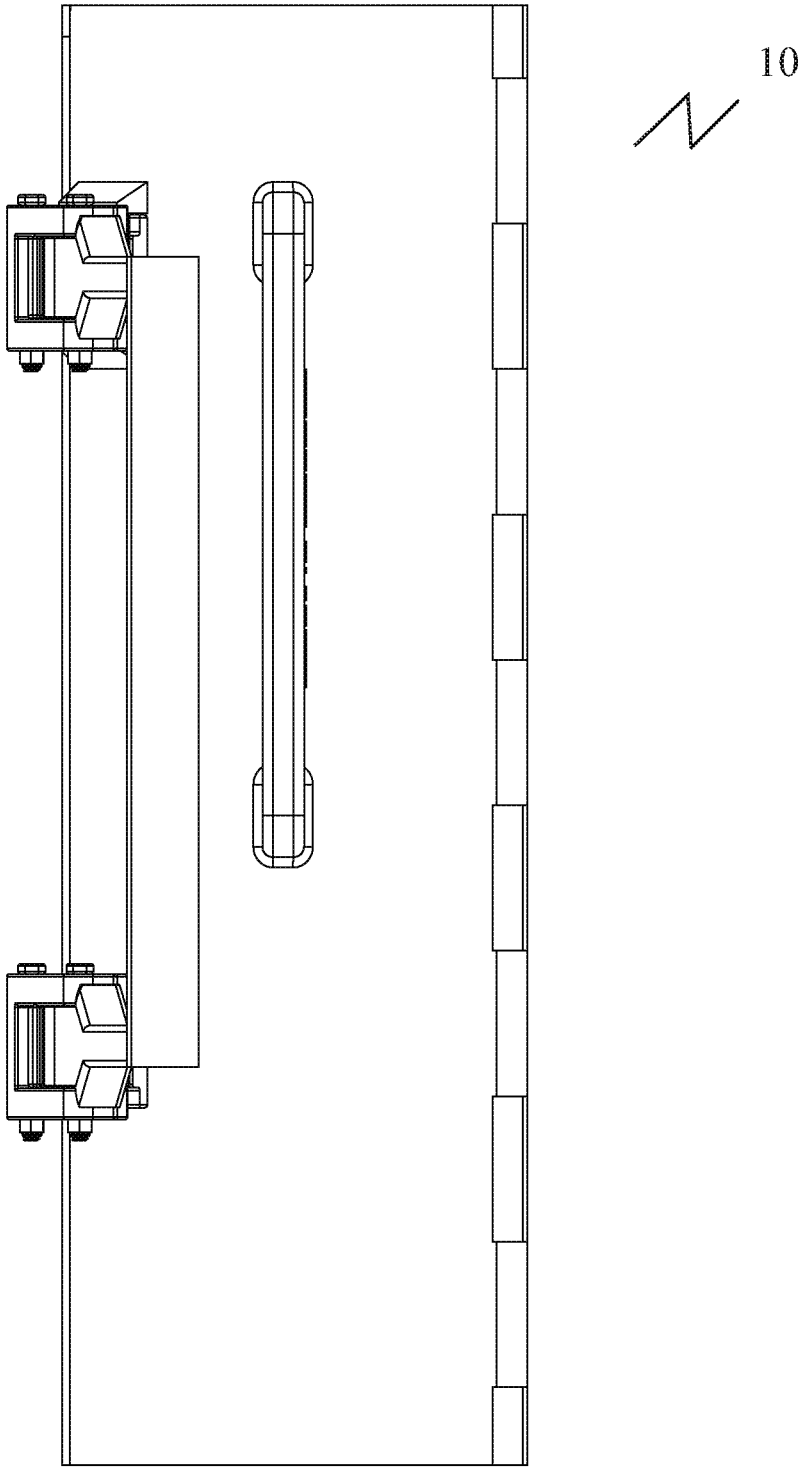
FIG. 3 is another side elevation view of the device of FIG. 1.
Figure 4:
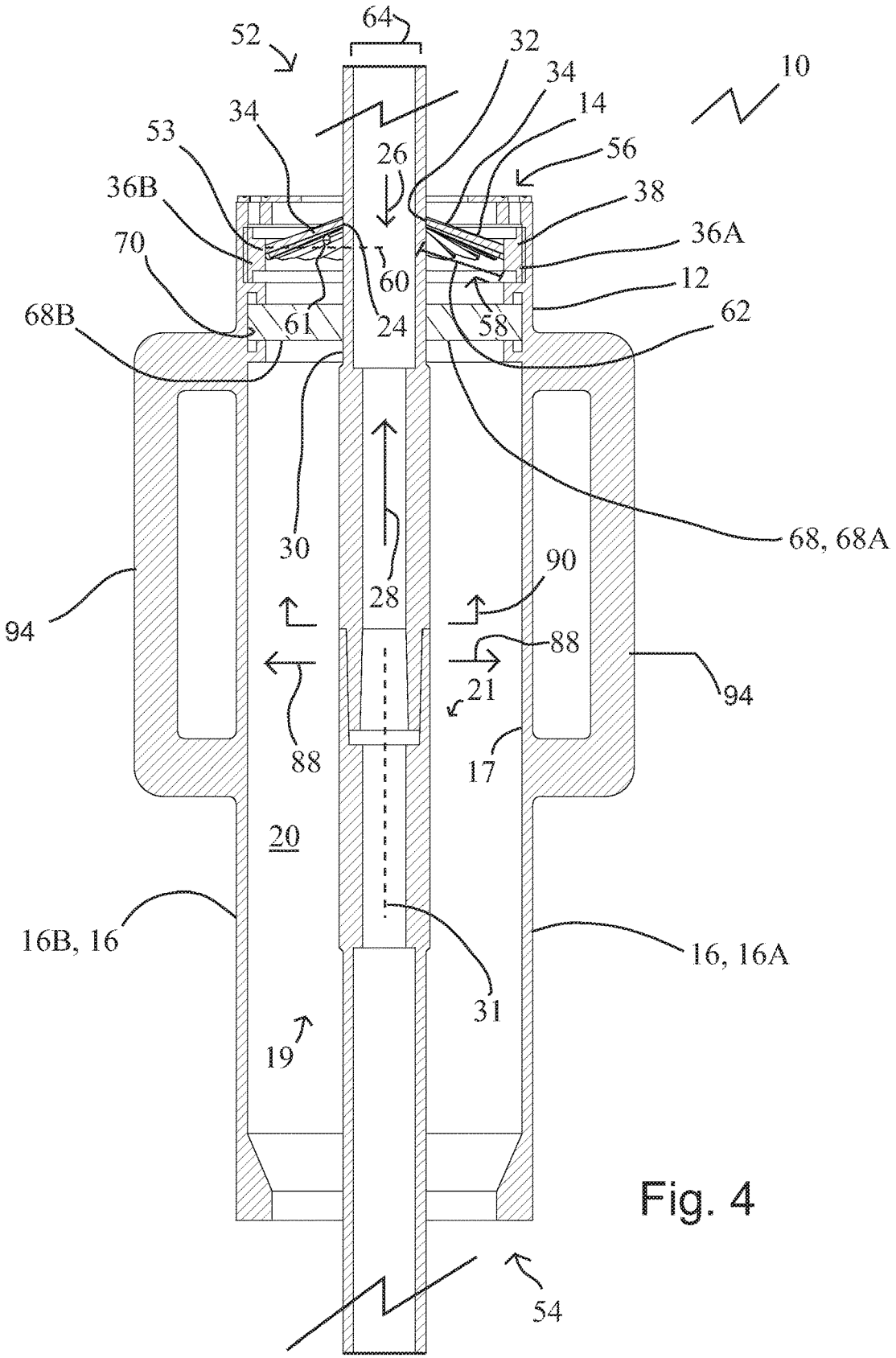
FIG. 4 is a section view taken along the 4-4 section lines from FIG. 2.

Referring to FIGS. 1-4 a well fluid containment device 10 is illustrated. Referring to FIG. 4, device 10 comprises a housing 12 and a safety mechanism 14. Referring to FIG. 2, housing 12 may be formed of sections 16, which may be connected together, for example by a hinge 18. The sections 16 may be arcuate sections as shown, although other shapes may be used, including sections that make up a housing 12 with a polygonal cross-sectional shape perpendicular to the pipe axis. The housing 12 has an interior wall 17 defining a pipe joint passage 20. The housing 12 acts as a fluid shield or shroud that contains and redirects lateral streams of pressurized fluid released when a pipe joint 21 (FIG. 4) is disconnected. Thus the housing 12 is sized to contain pipe joint 21 within the pipe joint passage 20. Housing 12 may be composed of a reinforced structure block. Hinge 18 allows sections 16 to pivot relative to one another to open and close in clam shell fashion to enclose a portion of pipe 19 (FIG. 4). A hinged connection between sections 16 is not required. A connector, for example formed of connecting parts, for example one or more parts of a tension latch 22, may be between the sections 16. Latch 22 maintains the sections 16 in the closed position shown, to prevent opening of sections 16 when exposed to pressurized fluid release from pipe joint 21.

Referring to FIG. 4, the safety mechanism 14 is supported by the housing 12. Safety mechanism 14 has a pipe gripping surface 24, which resists movement when contacted in a first axial direction 26. When a pipe segment 30, such as a kelly, is positioned within pipe joint passage 20, the surface 24 grips the pipe segment 30 with a gripping force normal to a pipe axis 31. Thus, if housing 12 is pushed upward by a force in a second axial direction 28 opposed to the first axial direction 26, the pipe gripping surface 24 will experience a force in the first axial direction 26 from the pipe segment 30, and the housing 12 will resist movement relative to pipe segment 30. The safety mechanism 14 thus operates as a pipe grappler that seizes and holds the pipe segment 30.

In some cases, when the pipe gripping surface 24 is contacted with a first force in the first axial direction 26, the surface 24 resists movement with an opposing force that increases as the first force increases. Contact in first direction 26 occurs by an axial contact force applied to pipe gripping surface 24. In cases such as the one shown the safety mechanism is configured such that an increase in the axial contact force causes an increase in the normal force applied by surface 24 against pipe segment 30, and hence an increase in a maximum axial force of static friction opposing the axial contact force. Thus, the resistance to movement increases with increasing axial contact force.

Figure 5:
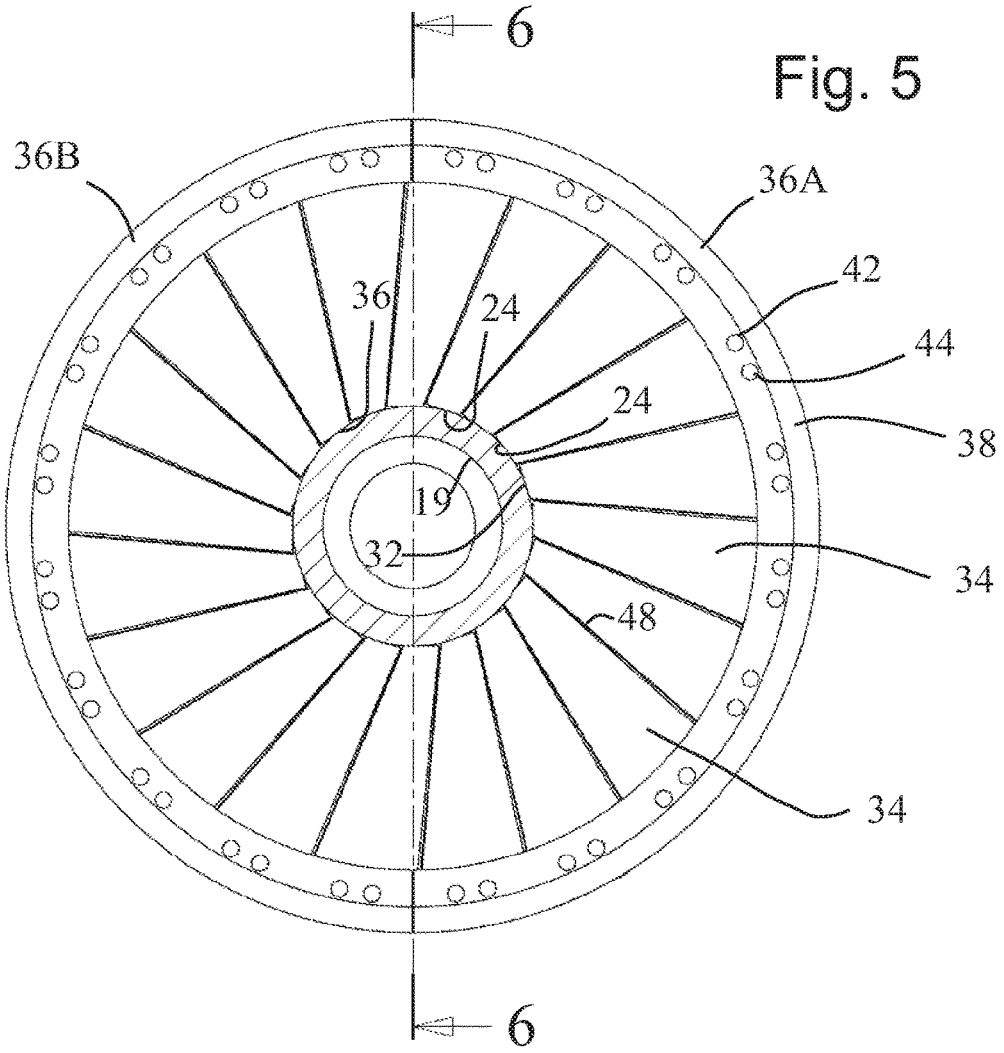
FIG. 5 is a top plan view of a safety mechanism supported by the device of FIG. 4.
Figure 6:
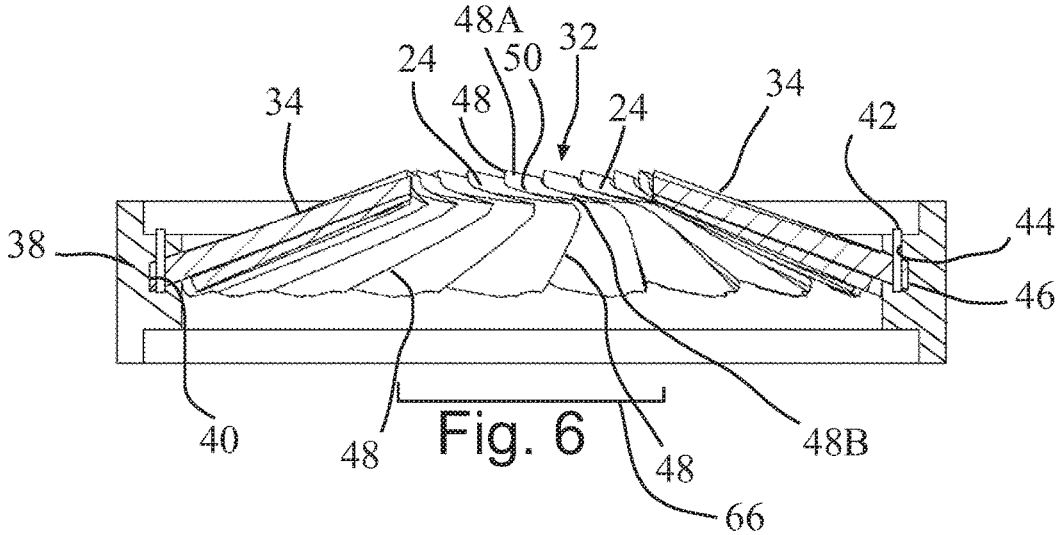
FIG. 6 is a section view taken along the 6-6 section lines from FIG. 5.

Referring to FIGS. 4-6, the safety mechanism 14 may comprise a shoulder 32, which may itself be separated into plural members such as arms 34 as shown. The plural arms 34 may be circumferentially arranged about the interior wall 17 of housing 12. The shoulder 32 extends, for example projects, from the housing 12 and defines the pipe gripping surface 24. In the example shown each plural member or arm 34 defines a respective pipe gripping surface 24. The mechanism 14 may form a collar 36 that is disposed about the pipe joint passage 20 and defines the pipe gripping surface 24. The safety mechanism 14 may be radially split into segments 36A and 36B, and each segment being mounted within a respective section 16A and 16B to permit the mechanism 14 to be opened and closed around a pipe section 30 with the sections 16.

In the embodiment shown the mechanism 14 comprises twenty arcuate arms 34. An annular rim 38 surrounds and supports the arms 34 within an inner circumferential groove 40. Each arm 34 may be secured to the interior wall 17 or rim 38 using a respective fastener or fasteners 42. The fasteners 42, which may be safety locking pins as shown, permit quick replacement of selective ones of the arms 34 if necessary for example due to different sizing or damage. The fasteners 42 may fit within respective axial holes 44 within rim 38. Safety locking pins may be oversized for holes 44 in order to secure the pins (fasteners) 42 by friction.

The plural arms 34 may each have an arcuate shape as shown, for example when viewed along the pipe axis 31. The plural arms may overlap one another, for example as shown. Each arm 34 shown has a rim edge 46, side edges 48, an inner edge defining the pipe gripping surface 24, a top face 56 and a bottom face 58. When in the closed position shown, each side edge 48 may overlap with an adjacent side edge 48 of one or more neighboring arms 34. Referring to FIG. 6, arms 34 may be separated by radial cuts 50, the portion of the cuts corresponding to the side edges 48 each having one or more of a slant, curved, or segmented shape in the axial direction when viewed from the pipe axis 31, such shape defining the overlap of arms 34 with one another.

In the example shown the cuts 50 have a sideways J shape so that each arm 34 has a thickened lead arc portion 48A and a thin trailing arc portion 48B, or vice versa. Other shapes of cuts 50 may be possible. The word cut does not require actual cutting techniques and instead defines only the shape of each arm 34 34. Overlapping of arms 34 provides additional strength and multiple edges that form gripping surfaces 24 to apply gripping force onto the body of pipe segment 30.

Referring to FIG. 4, the second axial direction 28 is oriented toward a first end 52 of the housing 12, first end 52 being opposed to a second end 54. Both ends 52 and 54 may be open ends as shown to accept passage of a pipe in one end and out the other or vice versa. The shoulder, for example plural members or arms 34 may extend radially inwards and, in this case up, toward the first end 52, terminating in the respective pipe gripping surfaces 24. Such a configuration is possible in one case if each of the plural arms 34 is slanted toward the first end 52 from an arm base 53 to a respective pipe gripping surface 24.

The arms 34 may have a generally planar cross sectional profile defined in a plane or series of planes defined along and parallel to the pipe axis 31 as shown. In FIG. 4 one such plane is defined by the surface of the page. Other cross sectional profile shapes are possible, including one that is wider at the arm base 53 than at a tip (pipe gripping surface 24). In the example shown each arm 34 is angled up toward the first end 52 from arm base 53 to a respective pipe gripping surface 24, so that the arm 34 is closer to the first end 52 with decreasing distance from pipe axis 31. Each arm 34 may form an acute angle 61 with a plane 60 perpendicular to a pipe axis 31 and passing through arm base 53. Acute angles 61 may be defined between plane 60 and both a top face 56 and a bottom face 58, as defined in the plane of the page, of arm 34. In other cases one of faces 56 and 58 are angled, or both may be angled but at different angles with respect to a plane or planes 60. Other cross sectional profiles are possible. For example one or both of faces 56 and 58 may be formed of profiles that are one or more of curved, slanted, or segmented, in order to achieve an overall angled orientation.

The combination of angled arms 34 and gripping surfaces 24 is one way to achieve increased gripping force and movement restriction upon pipe gripping surface 24 being contacted in a first axial direction 26. For example, when housing 12 is pushed upwards, gripping surfaces 24 are torqued downwards to compress arms 34 and increase the gripping force of surfaces 24 on pipe section 30.

In some cases safety mechanism 14 permits movement when pipe gripping surface 24 is contacted in second axial direction 28. Pipe gripping surfaces 24 may thus function as a one way valve for a portion of pipe 19 to move down but not up relative to device 10. For example, the pipe gripping surface 24 may be configured to deflect outward when contacted in the second axial direction 28. Angled arms 34 are one way to achieve such an objective, provided that arms 34 or a portion of each arm 34 is able to pivot, even to a limited degree relative to housing 12. In the example shown, each arm 34 is made of rigid material, and minor tolerances within inner circumferential groove 40 permits limited pivoting of arm 34 when under a force in the second axial direction 28. Thus, if housing 12 is pushed downwards relative to pipe segment 30, arms 34 experience an axial contact force in second axial direction 28, and would thus pivot upwards to reduce the gripping force of gripping surfaces 24 upon pipe segment 30, thus permitting relative movement between pipe segment 30 and surfaces 24.

In some cases arm 34 may itself be resilient, to permit limited pivoting along an arm length 62, while retaining sufficient rigidity to avoid crumpling when under a load in the first axial direction 26. Each arm 34 may consist of rigid material. Other ways of achieving such objectives may be used. The combination of arms 34 arranged as a collar 36 about pipe axis 31 provides a shoulder 32 with the general shape of an upside down funnel. The overlapping edges 48 may ensure a fluid seal or at least an axial line-of-sight fluid block even under deflection when arms 34 are contacted in the second axial direction 28. Arms 34 may comprise suitable material, for example one or more of metal, plastic, polypropylene, carbon fiber, fiber glass, and wood. Other materials may be used.

Thus, in the example shown the safety mechanism 14 acts as a grapple. When contacted in one direction, the grapple deflects outward to permit the pipe to pass. When contacted in the other direction, the grapple deflects or bites inward to restrain the pipe.

Referring to FIGS. 4 and 6 the arms 34 are shown in stressed and unstressed positions, respectively. In the example shown each arm has a length 62 defined from arm base 53 to pipe gripping ends 24. The slant angle 61 and arm length 62 for each arm is selected such that in the unstressed position (FIG. 6) the arms 34 define a collective mouth radius 66 (FIG. 6) that is narrower than a pipe radius 64 (FIG. 4) of a pipe section 30. Thus, when placed around pipe segment 30 arms 34 are displaced outward, resulting in a gripping force normal to the pipe segment 30 when in a neutral, pipe gripping orientation.

Safety mechanism 14 may function as a fluid seal. Referring to FIG. 4 in some cases a pipe seal 68 may line the interior wall 17 at or near a top or first end 52 of the housing 12. The seal 68 is shown lodged within an inner circumferential groove 70 of wall 17, seal 68 being supplied split into sections 68A and 68B, each mounted on a respective section 16A and 16B, respectively, to permit opening and closing of the seal 68 over the pipe segment 30. The safety mechanism 14 may be closer to the top end 52 than the pipe seal 68. In some cases the safety mechanism 14 may itself define the top end 52 of the device 10. Pipe seal 68 may be a quick exchange seal to accommodate portions of pipe 19 of varying diameters.

Referring to FIGS. 1 and 2 connectors, such as tension latches 22, may be used to secure together sections 16. Tension latches pull two components together and secure them together by an over or under center latching mechanism. Tension latches provide ease of use (most of them are hand operated) and fast operation. Each tension lock 22 may have a catcher 72 on one section 16A, and a claw 74 pivotally mounted on a base 76 on the other section 16B. Claw 74 is part of a cam handle 78 pivotally mounted to base 76 to draw claw 74 against catcher 72 on rotation, bringing sections 16A and 16B under tension when handle 78 is rotated to a closed position as shown. Latches 22 are spaced along an axial interface 80 between sections 16, the interface being defined by mating edges 82A, 82B of sections 16A and 16B, respectively. Interface 80 may form a fluid seal. Plural latches 22 keep the two halves of the device 10 closed when receiving a high volume of fluids from the static pressure released when breaking the pipe connection. Latches 22 may be gang-operated by an extension handle 84 connected to both cam handles 78 to close both latches 22 at the same time. The extension handle 84 allows a user to handle and apply the device 10 with better stability.

Referring to FIG. 1, each tension latch 22 is an example of a connector. Other types of connectors may be used for connecting the sections 16 together. The connector may be configured to release and secure the sections together, for example if the connector is a lock, clamp, or latch, between an open position and a closed position around a pipe connection. There may be one or more connectors on the sections 16, for example a first connector 23 and a second connector 25, with the first connector 23 closer to a base end 27 of the housing 12 than to a top end 52 of the housing 12.

Another example of a connector is a pressure relief connector, which in FIG. 1 refers to the first connector 23. A pressure relief connector performs dual functions: a) connecting two or more housing sections 16, and b) relieving excess internal pressure exerted on sections 16 when a pipe connection is broken within housing 12. A pressure relief connector may be partially or completely constructed of a resilient material that stretches under excess tension, only to return to an unstretched or less stretched state once the excess tension is removed. For example, one or more portions, such as claw 74, may perform the stretching function and may couple connecting parts 76 and 72, on sections 16A and 16B, respectively. Stretching may occur in a radial direction 77 perpendicular to a pipe axis 31 (FIG. 4), so that the sections 16 pivot slightly relative to one another sufficient to increase the volume within, and circumference of, the housing 12. The sections 16 may be configured to prevent lateral release of fluids on expansion, for example using overlapping mating flanges 79 that seal in a slightly opened state (FIG. 2). The radial direction 77 may be a circumferential direction as shown. Suitable materials such as synthetic or natural polymers, for example urethane or rubber, respectively, may be used, and the resiliency of the material may be tailored to provide a suitable expansion v. pressure profile.

Under ambient pressures while secured in a closed position, and under latching tensions while closing in the case of a tension latch, the connector may hold the sections 16 together in a relatively unstretched state. Under excess pressures, such as those experienced during breakout of a pipe connection with fluids pressurized above average pressures, the fluid pressure from the pipe breakout may push laterally against sections 16, surpassing a predetermined stretch pressure threshold for above-nominal-stretching thus causing the connector 23 to stretch. Stretching causes limited opening of the housing 12, such as the base end 27 of the housing 12. The limited expansion provides a larger volume in housing 12 to contain fluids, and if using an open-ended base end 27, a larger cross sectional area to permit drainage of a relatively greater flow of fluids at a relatively reduced pressure than if no pressure relief connector were used. The expansion occurs without disconnecting or opening the connector 23, which may be a lock. In one case only connector 23 is a pressure relief connector, with connector 25 being a regular rigid connector, thus permitting stretching at base end 27 only of housing 12. The connector 23 may be closer to the base end 27 than top end 52 of housing 12.

In some cases a safety mechanism such as a rigid backup connector may be used to prevent stretching beyond a predetermined degree. For example, a chain or rigid wire (not shown) may be connected between parts 76 and 72 and provided with slack under normal pressures to permit stretching of connector 23 under acceptable pressures above the predetermined threshold required to stretch the connector 23. However, under pressures at or above a predetermined danger threshold, the backup connector may be become taut thus preventing over stretching and breakage of the connector 23.

Referring to FIG. 4, a method of containing well fluids is described, for example for use in containing well fluids released upon pipe joint while performing a trip out operation on a drill string. A housing 12 is mounted around a portion of pipe 19. The housing 12 may be manipulated into position using one or more handles 94. In the example shown mounting is achieved by swinging sections 16 from an open position (not shown) to a closed position (shown) about hinge 18 (FIG. 2). Referring to FIGS. 1 and 2, mounting may be completed by connecting the sections 16 together, for example using tension latches 22. Referring to FIG. 4, when under no axial load safety mechanism 14 grips the portion of pipe 19 above a pipe joint 21.

In a next stage the pipe joint 21 may be disconnected to release well fluids, such as drilling fluids. The fluids may or may not be pressurized above hydrostatic. Because of the excess pressurization, or merely the hydrostatic pressure of the fluid in the pipe segment 30 on itself, disconnection or breaking of the joint 21 releases fluids along lateral direction lines 88. When the fluid encounters the interior wall 17, some fluid may be redirected upwards along direction lines 90. Fluid travelling along direction lines 90 may impart an upward force on housing 12, thus exposing pipe gripping surfaces 24 to an opposing contact force in a downward or first axial direction 26, leading to increase pipe gripping and resistance to upwards movement of housing 12. The housing 12 thus is able to receive a high volume of fluids from the static pressure released when breaking the pipe connection 21, while maintaining a protective position over pipe joint 21 to prevent exposure to users of lateral streams of pressurized well fluids. Fluid drains downward and out of the device 10 by an appropriate method, such as through open end 54 through the rotary table and slips (not shown). In other cases fluid drains out of device 10 through an outlet such as a lateral drain outlet (not shown).

Arm angling may be achieved by placing the arms 34 in a diagonal or slanted position relative to the pipe portion 19. In some cases the profile of one or more of faces 56 and 58 may not be diagonal but may still have a sufficient rise to achieve a gripping function, for example if a variable angle, parabolic, segmented, or other shape is used. Part of each member 34 may pivot relative to the part of the member 34 that defines the pipe gripping surface 24. The pipe gripping surface 24 may be textured for gripping, for example if a sharkskin texture is used. Surface 24 may be defined by a pad (not shown) of material at the end of each arm 34, such pad composed of material with a sufficiently high coefficient of static friction to achieve gripping.

Plural members or arms 34 may be arranged in a non-collar embodiment, for example, if two or more arms 34 are radially staggered about the pipe axis 31, with radial spaces in between the arms 34, and provide opposing gripping forces normal to the pipe segment 30. Each arm 34 need not be diametrically opposed to a second arm on the other side of the pipe segment 30, for example if three arms were spaced at one hundred and twenty degree intervals about the pipe axis 31. Each of the plural members or arms 34 may be C-shaped pads. Housing 12 may have a non-cylindrical shape, for example if housing 12 forms a hollow rectangular box, a coffin shape, or other suitable shapes. Arms 34 may define an angle 61 of less than forty five, and in some cases less than thirty degrees with respect to plane 60.

Stated functions may be achieved by one or more of structuring or positioning the safety mechanism 14 or components of the safety mechanism 14. Pipe gripping surfaces 24 may terminate members or arms 34. Members or arms 34 may be anchored to an exterior of housing 12 in some cases (not shown). Circumferential arrangement of members or arms 34 may include radial gaps between members or arms 34. Resistance to movement includes prevention of movement. Teaching discussed with respect to plural arms 34 in this document is applicable to shoulders or plural members unless context dictates otherwise. Relative language such as up, down, upward, downward, top, bottom, and lateral are relative terms and not intended to be limited to definitions tied to the position of the surface of the earth. Gripping is distinct from the function achieved by a pipe wiper, which permits the pipe to slide through the wiper with nominal or no resistance to movement. Device 10 may be used on other tubulars, not just kelly tubulars. The connector in some cases comprises a hinge, or a part of a hinge.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property of privilege is claimed are defined as follows:

1. A well fluid containment device comprising:

a housing formed of sections connected together, the housing having an interior wall defining a pipe joint passage;

a safety mechanism supported by the housing and having a pipe gripping surface that prevents movement when contacted in a first axial direction and permits movement when contacted in a second axial direction opposed to the first direction; and a pipe seal lining the interior wall near a top end of the housing, and the safety mechanism is closer to the top end than the pipe seal;

wherein the safety mechanism comprises a shoulder that extends from the housing and defines the pipe gripping surface and the second axial direction is toward a first end of the housing, and the shoulder extends radially inwards and toward the first end, and terminates in the pipe gripping surface.

2. The well fluid containment device of claim 1 in which the pipe gripping surface deflects outward when contacted in the second axial direction.

3. The well fluid containment device of claim 1 in which the safety mechanism comprises a collar disposed about the pipe joint passage and defining the pipe gripping surface.

4. The well fluid containment device of claim 1 in which the shoulder has the general shape of an upside down funnel.

5. The well fluid containment device of claim 1 in which the shoulder consists of rigid material.

6. The well fluid containment device of claim 1 in which the shoulder is separated into plural members, each plural member defining a respective pipe gripping surface.

7. The well fluid containment device of claim 6 in which the plural members each have an arcuate shape.

8. The well fluid containment device of claim 7 in which the plural members overlap one another.

9. The well fluid containment device of claim 8 in which the plural members comprise plural arms circumferentially arranged about the interior wall.

10. The well fluid containment device of claim 9 in which the second axial direction is toward a first end of the housing, and each of the plural arms is angled toward the first end from an arm base to a respective pipe gripping surface.

11. The well fluid containment device of claim 6 in which each of the plural members is secured by a respective fastener.

12. The well fluid containment device of claim 1 further comprising a portion of pipe positioned in the pipe joint passage, the portion of pipe being gripped by the pipe gripping surface, the portion of pipe comprising a pipe joint.

13. A well fluid containment device comprising:

a housing formed of sections connected together, the housing having an interior wall defining a pipe joint passage;

a safety mechanism supported by the housing and having a pipe gripping surface that prevents movement when contacted in a first axial direction and permits movement when contacted in a second axial direction opposed to the first direction;

wherein the safety mechanism comprises a shoulder that extends from the housing and defines the pipe gripping surface, and the shoulder is separated into plural members, each plural member defining a respective pipe gripping surface;

wherein the plural members each comprise arcuate arms circumferentially arranged about the interior wall, in which the plural arms overlap one another, and wherein the second axial direction is toward a first end of the housing, and each of the plural arms is angled toward the first end from an arm base to a respective pipe gripping surface.

14. The well fluid containment device of claim 13 in which each of the plural members is secured by a respective fastener.

15. A well fluid containment device comprising:

a housing formed of sections connected together, the housing having an interior wall defining a pipe joint passage;

a safety mechanism supported by the housing and having a pipe gripping surface that prevents movement when contacted in a first axial direction and permits movement when contacted in a second axial direction opposed to the first direction; and a pipe seal lining the interior wall near a top end of the housing, and the safety mechanism is closer to the top end than the pipe seal;

wherein the safety mechanism comprises a shoulder that extends from the housing and defines the pipe gripping surface;

in which the shoulder is separated into plural members comprising plural arms circumferentially arranged about the interior wall, each plural member defining a respective pipe gripping surface, in which the plural members each have an arcuate shape and overlap one another; and wherein the second axial direction is toward a first end of the housing, and the shoulder extends radially inwards and toward the first end, and terminates in the pipe gripping surface.

16. The well fluid containment device of claim 15 in which the pipe gripping surface deflects outward when contacted in the second axial direction.

17. The well fluid containment device of claim 15 in which the safety mechanism comprises a collar disposed about the pipe joint passage and defining the pipe gripping surface.

18. The well fluid containment device of claim 15 in which the safety mechanism comprises a shoulder that extends from the housing and defines the pipe gripping surface.

19. The well fluid containment device of claim 18 in which the second axial direction is toward a first end of the housing, and the shoulder extends radially inwards and toward the first end, and terminates in the pipe gripping surface.

20. The well fluid containment device of claim 19 in which the shoulder has the general shape of an upside down funnel.

* * * * *